US008181617B2

(12) United States Patent
Kuhnert et al.

(10) Patent No.: US 8,181,617 B2
(45) Date of Patent: May 22, 2012

(54) LASER IGNITION FOR GAS MIXTURES

(75) Inventors: Dieter Kuhnert, Sinsheim (DE); Maurice Kettner, Karlsruhe (DE); Georg Maul, Wurzach (DE)

(73) Assignee: Multitorch GmbH, Sinsheim (DE)

( * ) Notice: Subject to any disclaimer, the term of this patent is extended or adjusted under 35 U.S.C. 154(b) by 312 days.

(21) Appl. No.: 12/593,119

(22) PCT Filed: Mar. 28, 2008

(86) PCT No.: PCT/EP2008/002470
§ 371 (c)(1),
(2), (4) Date: Jan. 20, 2010

(87) PCT Pub. No.: WO2008/119508
PCT Pub. Date: Oct. 9, 2008

(65) Prior Publication Data

US 2010/0147259 A1 Jun. 17, 2010

(30) Foreign Application Priority Data

Mar. 29, 2007 (DE) ..... 10 2007 015 036

(51) Int. Cl.
*F02P 23/04* (2006.01)

(52) U.S. Cl. ..... 123/143 B; 123/266

(58) Field of Classification Search ..... 123/260, 123/266, 143 B
See application file for complete search history.

(56) References Cited

U.S. PATENT DOCUMENTS

| | | | | |
|---|---|---|---|---|
| 4,416,226 | A * | 11/1983 | Nishida et al. | 123/143 B |
| 4,612,599 | A | 9/1986 | Ziegler | |
| 5,554,908 | A | 9/1996 | Kuhnert et al. | |
| 6,053,140 | A | 4/2000 | Feichtinger et al. | |
| 6,601,560 | B1 | 8/2003 | Serve | |
| 7,036,476 | B2 | 5/2006 | Wintner et al. | |
| 7,040,270 | B2 | 5/2006 | Herdin et al. | |
| 7,499,477 | B2 | 3/2009 | Winklhofer et al. | |
| 7,770,552 | B2 * | 8/2010 | Schultz | 123/143 B |
| 2003/0136366 | A1 | 7/2003 | Herdin et al. | |
| 2007/0064746 | A1 | 3/2007 | Winklhofer et al. | |
| 2007/0068475 | A1 * | 3/2007 | Kopecek et al. | 123/143 B |
| 2007/0099133 | A1 | 5/2007 | Hanenkamp et al. | |
| 2011/0120404 | A1 * | 5/2011 | Weinrotter et al. | 123/143 B |

FOREIGN PATENT DOCUMENTS

| | | | |
|---|---|---|---|
| DE | 2 207 392 | | 8/1973 |
| DE | 28 49 458 | A1 | 5/1980 |
| DE | 39 26 956 | A1 | 2/1991 |
| DE | 44 19 429 | A1 | 12/1995 |
| DE | 197 14 796 | A1 | 10/1998 |
| DE | 100 16 558 | A1 | 10/2001 |
| DE | 102 27 282 | A1 | 1/2004 |
| DE | 10 2004 039 818 | A1 | 3/2006 |
| DE | 10 2004 043 143 | A1 | 5/2006 |
| DE | 10 2004 061 194 | A1 | 10/2006 |
| DE | 10 2006 018 973 | A1 | 10/2007 |
| EP | 1 007 828 | B1 | 1/2003 |
| EP | 1329631 | A2 | 7/2003 |

(Continued)

*Primary Examiner* — Hai Huynh
(74) *Attorney, Agent, or Firm* — Walter A. Hackler

(57) ABSTRACT

An ignition device for the ignition of a gas mixture in a main combustion chamber (1), in particular of an internal combustion engine, is proposed, wherein the absorber body (5) is heated by means of a laser (8). A prechamber (10) is located upstream of the absorber body (5) on the combustion chamber inner side (6) in order to improve the ignition behavior.

17 Claims, 5 Drawing Sheets

FOREIGN PATENT DOCUMENTS

| | | | |
|---|---|---|---|
| EP | 1 476 926 | B1 | 11/2004 |
| FR | 2 873 763 | A1 | 2/2006 |
| FR | 2873763 | A | 2/2006 |
| JP | 59155573 | | 9/1984 |
| JP | 60150480 | | 8/1985 |
| JP | 63212772 | A | 5/1988 |
| JP | 8068374 | | 3/1996 |
| JP | 10196508 | | 7/1998 |
| WO | WO 98/45588 | | 10/1998 |
| WO | WO 03/071644 | A1 | 8/2003 |
| WO | WO 2004/001221 | A1 | 12/2003 |
| WO | WO 2005/021959 | A1 | 3/2005 |

* cited by examiner

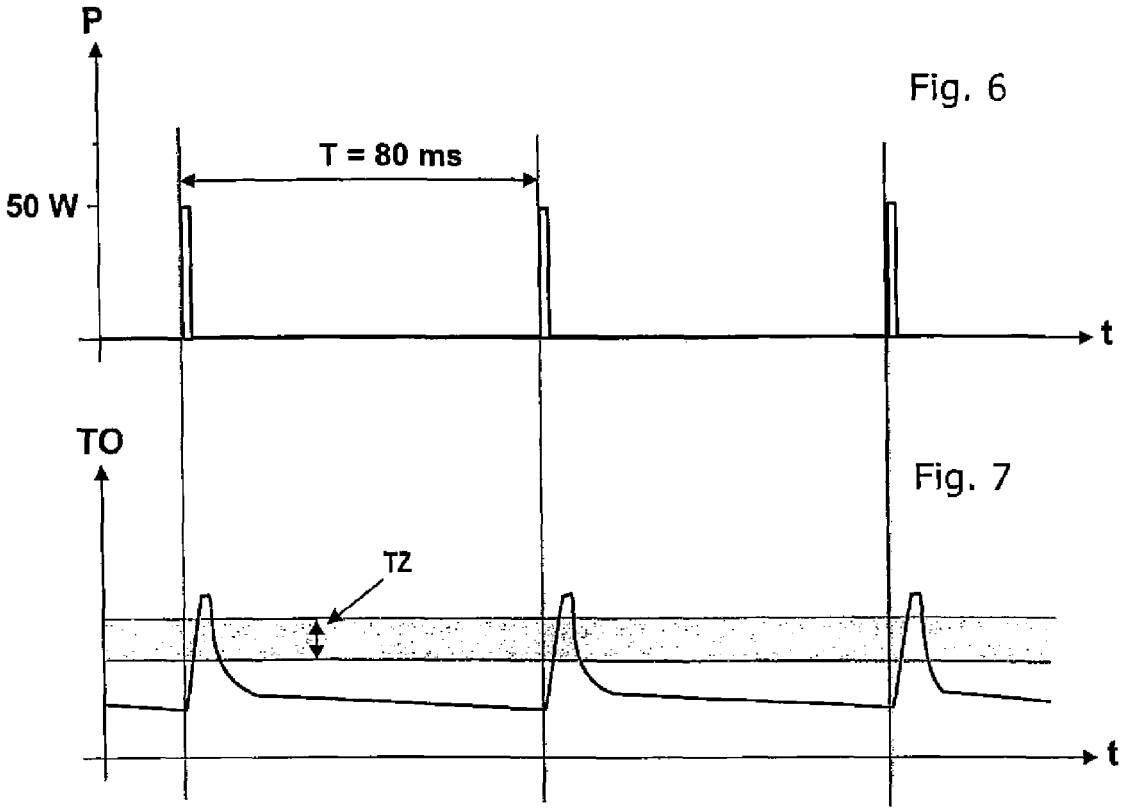
Fig. 6
Fig. 7
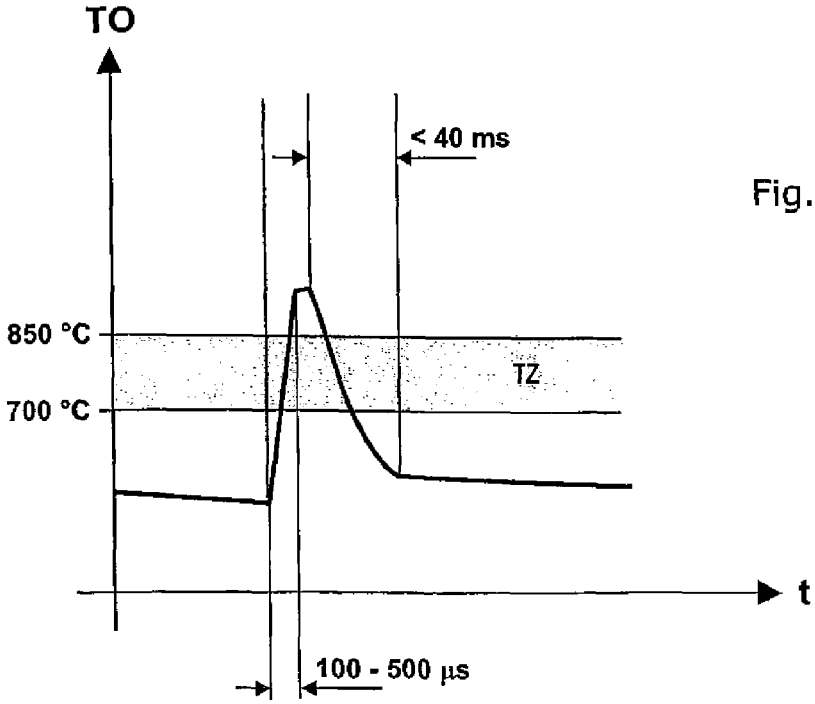
Fig. 8

LASER IGNITION FOR GAS MIXTURES

The invention relates to the area of the laser ignition of gas mixtures. It is directed in particular towards an ignition device for the ignition of a combustible or explosive gas mixture in a main combustion chamber, in particular for the ignition of a fuel-air mixture or a combustion gas-air mixture in an internal combustion engine, comprising a high temperature-resistant absorber body, which is arranged in contact with gas mixture coming from the main combustion chamber and which comprises a combustion chamber inner side facing the gas mixture, and a light guide path for guiding a laser beam onto the absorber body in order to heat the absorber body with the laser beam until an ignition temperature required for the ignition of the gas mixture is reached on the combustion chamber inner side of the absorber body, wherein the light guide path up to the absorber body is configured in such a way that the laser beam does not have direct contact with the gas mixture of the main combustion chamber, as well as a corresponding method.

The invention is therefore directed towards an ignition device and a method for the combustion of combustion gas-air mixtures with a hot-spot surface with rapidly changeable temperatures which is heated by a laser beam.

Lasers for generating laser beams are known in the prior art (see e.g. DE 39 26 956 A1). Furthermore, laser ignitions are known in the prior art, wherein the laser beam is focused onto a site inside the combustion chamber, i.e. runs a certain distance through the gas mixture to be ignited in the combustion chamber. This focus lies either on an absorber, which converts the laser light into heat, or directly in the gas mixture in the combustion chamber. These laser ignitions do not ignite with the desired reliability. Various laser ignition devices for internal combustion engines have been proposed in recent years. Hitherto, however, the latter have still been very expensive and elaborate (DE 28 49 458 A1, DE 199 11 737 A1, U.S. Pat. No. 6,053,140 A, WO 2005/028856 A1=EP 1 519 038 A1 and EP 1 519 038 A1, WO 2005/021959 A1, DE 203 20 983 U1=EP 1 329 631 A2, DE 103 50 101 A1, DE 10 2004 061194 A1, JP 10196508, JP 59155573, JP 60150480, JP 63212772, JP 8068374).

An essential drawback with such laser ignitions consists in the fact that they only generate an extremely small ignition core, wherein very markedly fluctuating charge states (composition, temperature, speed, turbulence) exist locally at the ignition site in connection with the comparatively large-eddy flow and turbulence structure in the combustion chamber, especially of large gas engines. Fairly large fluctuations therefore arise with the ignition and therefore, in particular, also with the engine torque. Furthermore, there is in the lean operation the particular problem that the mixture is extinguished again immediately after ignition, since too much heat is removed from the inner cone of the flame. For the aforementioned reasons, therefore, the ignition and combustion potential of laser ignition has hitherto not been able to be fully utilised. In the case of longer-term operation, contamination and deposits also arise on the surface of the optical window of the laser ignition device exposed to the raw combustion chamber conditions, which in the long-term operation leads to a reduction in the energy transmission from the laser ignition device to the ignition site. In addition, a rapid propagation of the flame front from the ignition site into all areas of the combustion chamber is not promoted in the case of laser ignition in the "open" combustion chamber.

Document DE 22 07 392 A discloses a generic ignition device. Such ignition devices, referred to as "hot-spot laser ignition", wherein the ignition takes place by heating a surface facing the combustion space by means of a laser, have however not so far gained acceptance in practice, because the ignition did not allow the high-frequency ignition pulses of internal combustion engines to be carried out with the required reliability, especially at higher speeds, or with a sufficiently long useful life.

WO 2004/001221 A1 describes a starting aid for an internal combustion engine, wherein an area disposed in the combustion chamber is heated by means of a laser beam. This area is heated constantly and is for example a glow pin projecting into the combustion chamber or another point in the combustion chamber. A prechamber is not provided.

A prechamber ignition with a laser has been proposed in DE 10 2006 018 973 A1 published after the priority date of the present application. The laser is focused on an ignition site, which lies in the gas-air mixture inside the prechamber.

Another prechamber ignition with a laser has been proposed in DE 10 2005 050 453 A1 published after the priority date of the present application. A section of the supporting device of a laser heating device, said section projecting into the prechamber space, is heated by means of a laser. The geometry and the material of the heated section of the supporting device are adapted to the required ignition conditions. The use of a separate absorber body heated by the laser is not disclosed.

The problem underlying the invention is to improve the properties of the known hot-spot laser ignitions in such a way that they can be used in a practical operation in internal combustion engines.

SUMMARY OF THE INVENTION

According to the invention, this problem is solved by an ignition device and a method with the features of the appended independent claims. Preferred embodiments and developments of the invention emerge from the dependent claims and the following description with the respective drawings.

The ignition device according to the invention for the ignition of a combustible or explosive gas mixture in a main combustion chamber, in particular for the ignition of a fuel-air mixture or a combustion gas-air mixture in an internal combustion engine, comprising a high temperature-resistant absorber body, which is arranged in contact with gas mixture coming from the main combustion chamber and which comprises a combustion chamber inner side facing the gas mixture, and a light guide path guiding a laser beam onto the absorber body in order to heat the absorber body with the laser beam until an ignition temperature required for the ignition of the gas mixture is reached on the combustion chamber inner side of the absorber body, wherein the light guide path up to the absorber body is configured in such a way that the laser beam does not have direct contact with the gas mixture of the main combustion chamber, thus has the distinctive feature that a prechamber with at least one overflow opening connecting the prechamber and the main combustion chamber is located upstream of the absorber body on the combustion chamber inner side, wherein the combustion chamber inner side of the absorber body is facing the gas mixture of the prechamber and the light guide path up to the absorber body is configured in such a way that the laser beam does not have direct contact with the gas mixture of the prechamber.

A corresponding method for the ignition of a combustible or explosive gas mixture in a main combustion chamber, in particular for the ignition of a fuel-air mixture or a combustion gas-air mixture in an internal combustion engine, wherein a high temperature-resistant absorber body with a combustion chamber inner side facing the combustion chamber inner side is arranged in contact with gas mixture coming from the main combustion chamber, and a laser beam is guided along a light guide path onto the absorber body, wherein the absorber body is heated by the laser beam until an ignition temperature required for the ignition of the gas mixture has been reached on the combustion chamber inner side of the absorber body, wherein the light guide path up to the absorber body is configured in such a way that the laser beam does not have direct contact with the gas mixture of the main combustion chamber, has the distinctive feature that a prechamber with at least one overflow opening connecting the prechamber and the main combustion chamber is located upstream of the absorber body on the combustion chamber inner side, wherein the combustion chamber inner side of the absorber body is arranged facing the gas mixture of the prechamber and the light guide path up to the absorber body is configured in such a way that the laser beam does not have direct contact with the gas mixture of the prechamber.

The feature that the light guide path up to the absorber body is configured in such a way that the laser beam does not have direct contact with the gas mixture of the combustion chamber or the prechamber is to be understood such that the combustion chamber or the prechamber is completely sealed off from the light guide path, i.e. the laser beam does not run through the main combustion chamber or the prechamber, or more precisely not through the gas mixture therein to be ignited.

Prechamber ignition is known with conventional ignition processes based on an electrical spark ignition. Prechamber ignition devices, in particular prechamber spark plugs, have been known for many years and have also been introduced into mass production, in particular in the case of gas engines operated with a lean mixture and/or stationary with exhaust gas return. They are used primarily to reduce the NOx raw emissions of an internal combustion engine with simultaneous low values for fuel consumption and a reduction in torque fluctuations. Such ignition devices are known as prechamber spark plugs in the English-speaking area.

The prechamber of an electrical prechamber spark plug is a small chamber which delimits a region around and/or a space lying in front of the ignition electrodes from the main combustion chamber, said chamber usually being provided with a plurality of holes arranged circumferentially and a central narrow hole, which are referred to as overflow openings or, particularly in the case of larger wall thickness of the prechamber, as overflow channels. During the compression phase, these narrow holes represent a high flow resistance; as a result, the compression pressure can only be adjusted with a time delay in the prechamber. Embodiments of prechamber ignitions are known with and without a corresponding piston trough, into which the prechamber dips in the compression stroke.

In the case of embodiments of prechamber spark plugs with enrichment of the fuel-air mixture in the piston trough, a pressure drop between the main combustion chamber and the prechamber occurs when the prechamber dips into the piston trough, so that the rich fuel-air mixture, which has been collected in the piston trough, enters through the narrow holes at a higher flow rate into the prechamber. Ideally, an ignitable, highly turbulent, relatively homogeneous mixture arises in the prechamber at the ignition point. This mixture is dependent neither on a special charge movement in the cylinder nor on a special injection jet geometry. Once the ignition has taken place, the flames shoot, due to the positive pressure drop, through the narrow holes into the main combustion chamber and quickly seize the remaining, relatively lean fuel-air mixture. Due to the emerging flame jets, broad areas of the lean fuel-air mixture in the main combustion chamber quickly and simultaneously participate in the combustion. The intensive penetration of the flame front in the main combustion chamber leads to a more rapid and more complete fuel conversion than in the case of a spherical flame propagation proceeding from an ignition site.

Due to the flow conditions during the compression and the increasing pressure difference between the main combustion chamber and the prechamber, which induces a flow out of the surroundings of the prechamber into the interior of the prechamber, the mixture present in the vicinity of a piston trough flows via the overflow holes into the prechamber. As a result of high flow rates during the inflow, a good mixture formation is produced for the heterogeneous fuel-air mixture of the cylinder and therefore a particularly combustible mixture in the prechamber. The mixture formation is therefore decoupled from the underlying internal cylinder flow, so that negative influences from cyclical fluctuations of the flow are minimised. After ignition of the homogeneous mixture in the prechamber, the ignited mixture in the form of flame jets shoots, as a result of the sharp increase in pressure, via the prechamber holes into the main combustion chamber and there ignites the heterogeneous basic mixture over a wide area.

The ignition process in the main combustion chamber is therefore triggered by a preceding prechamber ignition process. This prechamber ignition process comprises, in the case of prechamber spark plugs with electrodes, two stages, i.e. a charging step and a discharging step. During the charging step, the prechamber is filled by the compression stroke of the engine or piston with a fresh gas-air mixture. Residual gas from the preceding ignition is thereby pushed into a rear-lying area. A very rapid ignition of the ignition mixture is thus achieved in the prechamber during ignition. After the ignition of the mixture in the prechamber, the pressure and the temperature in the prechamber rise very quickly, so that the combustion products in the form of flame jets are pushed through the overflow openings of the prechamber into the main combustion chamber and trigger the ignition of the gas mixture there.

For further details concerning electrical prechamber ignitions, reference is made to the literature, for example documents WO 98/45588 A1, WO 03/071644 A1 and EP 0 675 272 A1.

Solutions have recently been proposed to improve the properties of prechamber ignitions, wherein better ignition and firing properties are achieved by enriching the lean mixture in the prechamber with fuel (DE 44 19 429 A1, DE 197 14 796 A1, DE 10 2004 039818 A1, DE 10 2004 043143 A1, DE 100 16 558 A1). These processes are however very costly, because they also require an additional mixture formation and injection system for forming the mixture in the prechamber, apart from the gas formation system for the main mixture in the main combustion chamber.

In the context of the invention, it has been found that the known concepts of hot-spot laser ignition and the prechamber can be combined in an advantageous way, in order to achieve an improved ignition of the main mixture in the main combustion chamber by means of hot-spot laser ignition that meets practical requirements.

The improvement in the properties of a laser ignition with an internal combustion engine is based on the displacement of the ignition site or the ignition area into a pre-chamber, in particular into a prechamber of a prechamber spark plug. A fuel-air mixture is fed from the main combustion chamber via overflow openings of the prechamber during the compression stroke. When the top dead center of the piston is approached, an ignition of the mixture takes place with the laser ignition in the prechamber, there being produced at the ignition site a flow state which is particularly favourable for the laser ignition and which enables the reliable ignition of the mixture. As a result of a particularly rapid combustion of the mixture in the prechamber, ignition flame jets are produced which lead to a rapid and uniform conversion of the mixture in the main combustion chamber.

The invention comprising a combination of hot-spot laser ignition with a prechamber arrangement improves the properties of hot-spot laser ignition, particularly in the case of large gas engines, with regard to safety and uniformity of the ignition and combustion, with at the same time high long-term properties, especially for the properties of feeding the laser ignition energy, and reduces the outlay on improving ignition with prechamber spark plugs, wherein in particular reliable ignition and uniform energy conversion with air ratios Lambda >2.0 are achieved, which is not possible with the respective individual system (hot-spot laser ignition, prechamber ignition).

The invention has the following advantages:

Compared to existing glow ignition processes (e.g. in the case of model-making engines) for the ignition of premixed mixtures with a constant surface temperature, it is possible with the invention to adjust the ignition point precisely and reproducibly in spark-ignited engines.

With a highly transient temperature control at the hot-spot in the prechamber spark plug, the same function results as with a known electrical prechamber spark plug, since a timely ignition of the combustible mixture takes place in the prechamber by the hot-spot.

The effect of a highly transient temperature control is that, before and after the ignition phase, all the wall temperatures in the laser hot-spot system lie reliably below the ignition temperature. The risk of uncontrolled glow ignitions is therefore avoided. With the conventional structure with metallic ignition electrodes and a ceramic spark plug foot, on the other hand, there is always the risk of glow ignitions, since limited surface zones give rise to glow ignitions due to insufficient heat being carried away.

Better ignition conditions arise due to the small-eddy turbulence structure inside the prechamber. The more reliable ignition with hot-spot systems requires that the mixture touches the hot surface with, as far as possible, small-eddy turbulence. As a result, the energy requirement due to the small dimensions of the turbulence eddies is less than in the case of large eddies. A particular feature of the flow in the prechamber is the small-eddy turbulence structure. In the combination of a hot-spot laser ignition with a prechamber, therefore, a much more reliable ignition is achieved than with a laser ignition or hot-spot laser ignition without a prechamber.

The ignition of the gas mixture in the prechamber is also supported by the comparatively higher wall temperatures of the prechamber with smaller heat losses than in the main combustion chamber.

The favourable ignition conditions make it possible to configure the hot-spot in such a way that a substrate area as small as possible (approx. 0.5 mm diameter) has to be changed by as small a temperature increase as possible. The cost outlay therefore falls and an economical operation can be achieved.

As a result of the wear on the ignition electrode arising with the spark ignition, the useful life of the prechamber spark plugs in a conventional design is limited. This drawback is made worse especially with high specific cylinder outputs (high mean pressures) due to the higher ignition voltage requirement as a result of the higher density level. Unavoidable wear ("erosion") of the electrodes thereby arises, as a result of which the useful life is limited. Especially with a further output increase of the engines (supercharging) and therefore the increasing higher ignition pressures, the breakthrough voltage and therefore the electrode wear increase. These wear problems do not exist with hot-spot laser ignition, since the surface temperatures on the absorber are much lower than on the ignition sparks. In addition, the tendency to ignition is greatly favoured by the higher density level. In general, the ignition device according to the invention exhibits imperceptible wear and therefore has a more or less unlimited useful life.

The invention creates an ignition device for the ignition of combustion gas-air mixtures with a high ignition pulse frequency in the combustion chamber of a spark-ignited engine.

BRIEF DESCRIPTION OF THE DRAWINGS

Further details and advantages of the invention will be explained with the aid of examples of embodiment making reference to the appended drawings. The described features can be used individually or in combination to create preferred embodiments of the invention.

In the drawings:

FIG. 6 shows a representation of the course of the laser pulse power as a function of time with the use of the invention in an internal combustion engine;

FIG. 7 shows a representation of the course of the surface temperature of the absorber as a function of time with the use of the invention in an internal combustion engine; and FIG. 8 shows a detail view in respect of FIG. 7.

DETAILED DESCRIPTION

Figure 1:
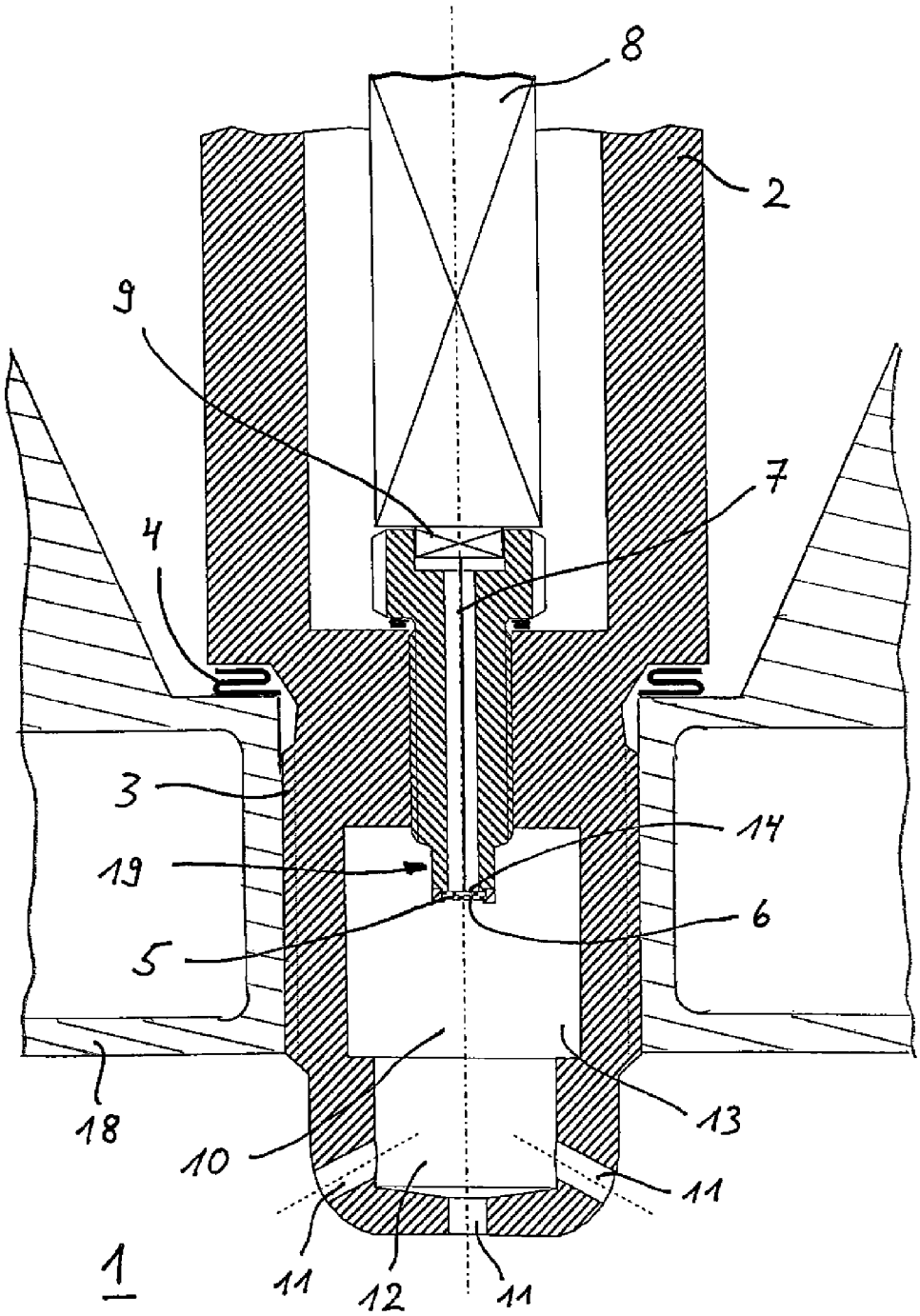
FIG. 1 shows a longitudinal section of a hot-spot laser spark plug with a prechamber in accordance with the invention.

FIG. 1 shows an ignition device according to the invention for the ignition of a combustible or explosive gas mixture in a main combustion chamber 1, in particular for the ignition of a fuel-air mixture or a combustion gas-air mixture in an internal combustion engine. With a hot-spot laser ignition according to the prior art, i.e. without prechamber 10, main combustion chamber 1 is the same as the combustion chamber ignited from the hot-spot. The ignition device is designed in the form of a spark plug 2 which can be mounted in the wall of a cylinder head 18. For this purpose, spark plug 2 comprises an external thread 3 and a gasket 4, with which it can be screwed in a sealed manner into the wall of cylinder head 18. It comprises a high temperature-resistant absorber body 5, which is arranged in contact with gas mixture coming from main combustion chamber 1, with a combustion chamber inner side 6 facing the gas mixture, i.e. the gas mixture in a prechamber 10.

Spark plug 2 also comprises a light guide path for guiding a laser beam 7 onto absorber body 5 in order to heat absorber body 5 with laser beam 7 until an ignition temperature required for the ignition of the gas mixture is reached on combustion chamber inner side 6 of absorber body 5, the light guide path up to absorber body 5 being configured such that laser beam 7 has no direct contact with the gas mixture of main combustion chamber 1 or prechamber 10. Laser 8 and, if need be, a laser beam lens system 9, can be integrated into spark plug 2.

Apart from absorber body 5 and the light path, spark plug 2 comprises a prechamber 10, which is located upstream of absorber body 5 on combustion chamber inner side 6, and overflow openings 11 connecting prechamber 10 and main combustion chamber 1. Pre-chamber 10 is designed as a hollow cylinder and advantageously comprises between 1 and 20, preferably 3 to 8 overflow openings 11. Overflow openings 11 can run through the wall of prechamber 10 axially and/or radially and/or obliquely, related to the axis in the longitudinal cross-section represented in FIG. 1.

Absorber body 5 is preferably not arranged with its wall flush in the wall of prechamber 10, but projects on a base or projection 19 a short distance into prechamber 10. Absorber body 5 is then arranged on a projection 19, which projects into prechamber 10 with a certain immersion depth. The immersion depth of projection 19 into prechamber 10 advantageously amounts to between 5% and 35%, preferably between 10% and 25% of the (axial) length of prechamber 10. This projection 19 has advantages for the creation of a "breathing space" for the mixture formation in prechamber 10, the formation of a favourable flow in prechamber 10 and the ignition behaviour of the gas mixture.

When spark plug 2 is screwed into the wall of main combustion chamber 1, i.e. into cylinder head 18, absorber body 5 is arranged in the region of the wall of main combustion chamber 1. Absorber body 5 is a high temperature-resistant substrate with or without a coating. The adjustment of the temperature of the surface facing prechamber 10, combustion chamber inner side 6, takes place by time-controlled heating of the rear side of absorber body 5, its combustion chamber outer side 14 facing away from prechamber 10. The heating takes place by means of pulsed laser beam 7, which strikes a rear substrate surface which absorbs as well as possible. Before the laser pulse is switched on, the surface temperature of combustion chamber inner side 6 projecting into prechamber 10 is below the temperature required for the mixture ignition. By switching on the laser pulse, the surface temperature is heated to a level such that a reliable mixture ignition takes place. The ignition point of the mixture is adjusted and controlled through the time of the heating.

Spark plug 2 with an, in particular, essentially cylindrical prechamber 10 in the form of an arrangement which can be screwed into a cylinder head 18 has a plurality of overflow openings 11, which produce a connection between prechamber 10 and main combustion chamber 1. The preferably centrally arranged laser device 8 has a beam lens system 9, which focuses laser beam 7 onto absorber body 5, so that the latter forms an ignition site. The entry jets into prechamber 10 generated during the compression stroke in overflow openings 11 preferably meet with their axes at a meeting point essentially close to the axis, said meeting point being located in the region of absorber body 5 or at a distance therefrom. The meeting point and its surroundings are a selected region inside prechamber 10 with high and particularly small-eddy turbulence which, particularly in connection with the very short discharge time of laser 8 with a high short-time power, is pre-eminently well-suited for a reliable ignition of the mixture in prechamber 10, with a desired, rapidly growing inner core of the flame.

It is particularly advantageous for the ignition that the fuel-air mixture to be ignited at absorber body 5 should pass from main combustion chamber 1 to the ignition site during the compression stroke. In this way, the non-combustible residual gas from the preceding working cycle still remaining alone in prechamber 10 at the start of the compression is displaced during the compression stroke by the emerging flow into the rear part of prechamber 10. In addition, this leads to particularly small fluctuations in the mixture composition and mixture temperature, because the mixture composition and the mixture temperature at absorber body 5 are each averaged out before prechamber 10, especially as a result of the inflow of the gas via overflow openings 11 from different regions of main combustion chamber 1. Due to the position of the ignition site essentially close to the axis, the extinguishing effects by solid surfaces on the inner cone of the flame forming after the ignition are also particularly small.

Figure 2:
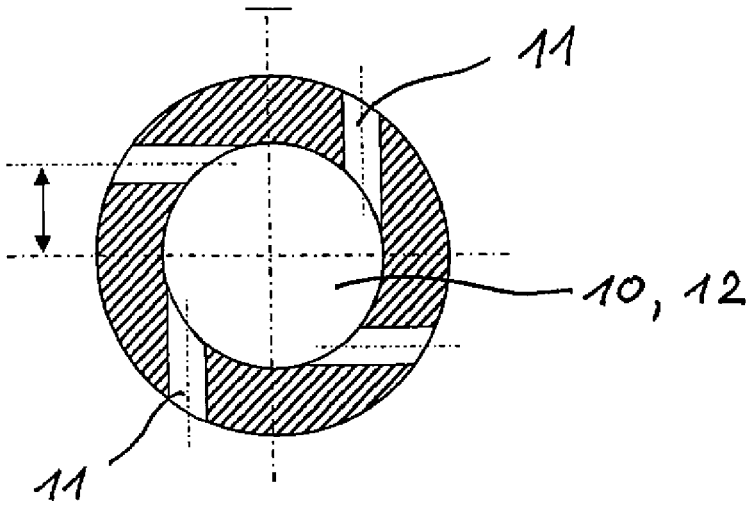
FIG. 2 shows a cross-section in respect of FIG. 1 in the plane of the oblique overflow openings.

The formation of a suitable flow in prechamber 10 can be improved if the prechamber comprises overflow openings 11 which run tangentially, as represented in the cross-section in FIG. 2, which runs in the plane of oblique overflow openings 11 in FIG. 1. Overflow openings 11 are not directed towards the axis, but (obliquely) tangentially onto a circle running around the axis, the radius whereof can lie between zero and the radius of prechamber 10. An advantageous rotary flow is thus formed in prechamber 10.

FIG. 1 shows the prechamber spark plug with a front prechamber 12 and a rear prechamber 13, overflow openings 11 emerging into front prechamber 12. A central overflow opening 11 is also represented, with which on the one hand an axial flow component in the direction of rear prechamber 13 is imparted to the gas mixture to be ignited by the beam entering into front prechamber 12 and a rotary flow is generated in rear prechamber 13 by the oblique, tangentially entering overflow openings 11. The effect of the axial flow component is that only fresh mixture from main combustion chamber 1 is present at the hot-spot at the ignition point and, after ignition of the fresh mixture, the flame propagation in rear prechamber 13 is greatly accelerated by the rotary flow that is present. The rapid ignition also reaches the mixture present in front prechamber 12 and flame jets exit into main combustion chamber 1, which bring about a particularly rapid and uniform conversion of the main mixture in main combustion chamber 1.

In general, it is advantageous if prechamber 10 is divided in the axial direction into a front prechamber 12 and a rear prechamber 13, wherein rear prechamber 13 is positioned farther away from main combustion chamber 1 than front prechamber 12 and wherein the diameter of rear prechamber 13 is greater than the diameter of front prechamber 12. To advantage, the diameter of rear prechamber 13 is between 5% and 100%, preferably between 10% and 30% greater than the diameter of front prechamber 12. The (axial) length of rear prechamber 13 advantageously amounts to between 5% and 200%, preferably between 10% and 80% of the length of front prechamber 12. The formation of a rear prechamber 13 has advantages for the creation of a "breathing space" for the mixture formation in prechamber 10, the formation of a favourable flow in prechamber 10 and the ignition behaviour of the gas mixture.

Figure 3:
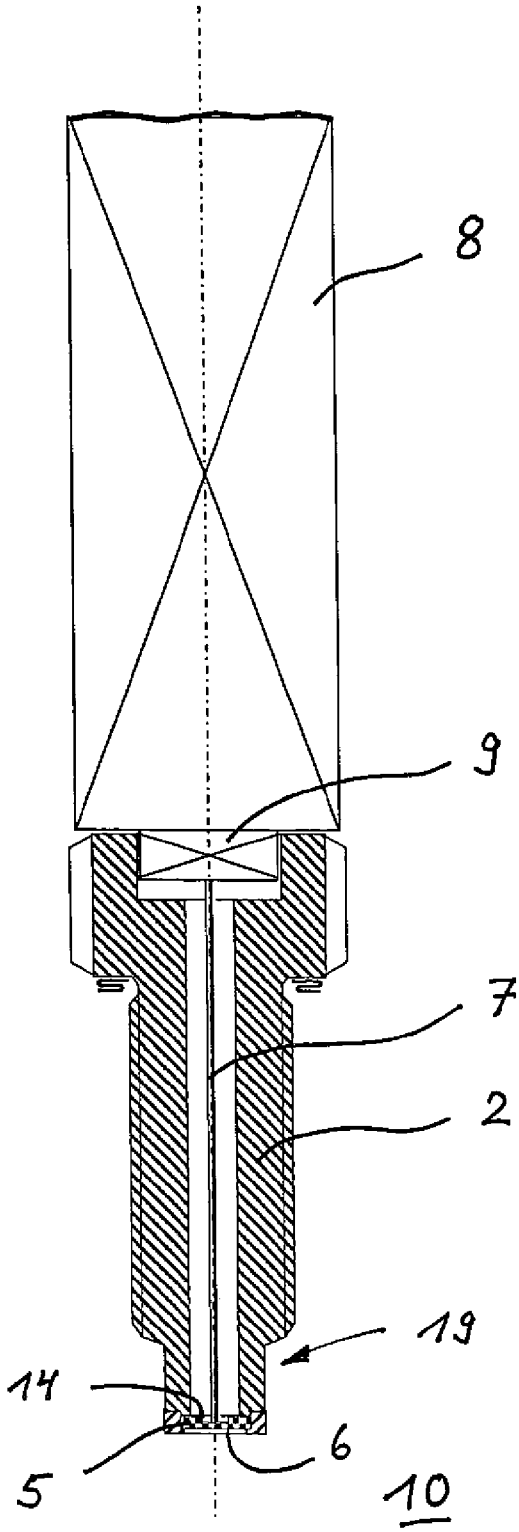
FIG. 3 shows a detail view in respect of FIG. 1.

FIG. 3 shows a detail in respect of FIG. 1, i.e. laser 8, beam lens system 9, the light guide path and absorber body 5. Prechamber 10 and the external housing of spark plug 2 are not shown in this representation.

Figure 4:
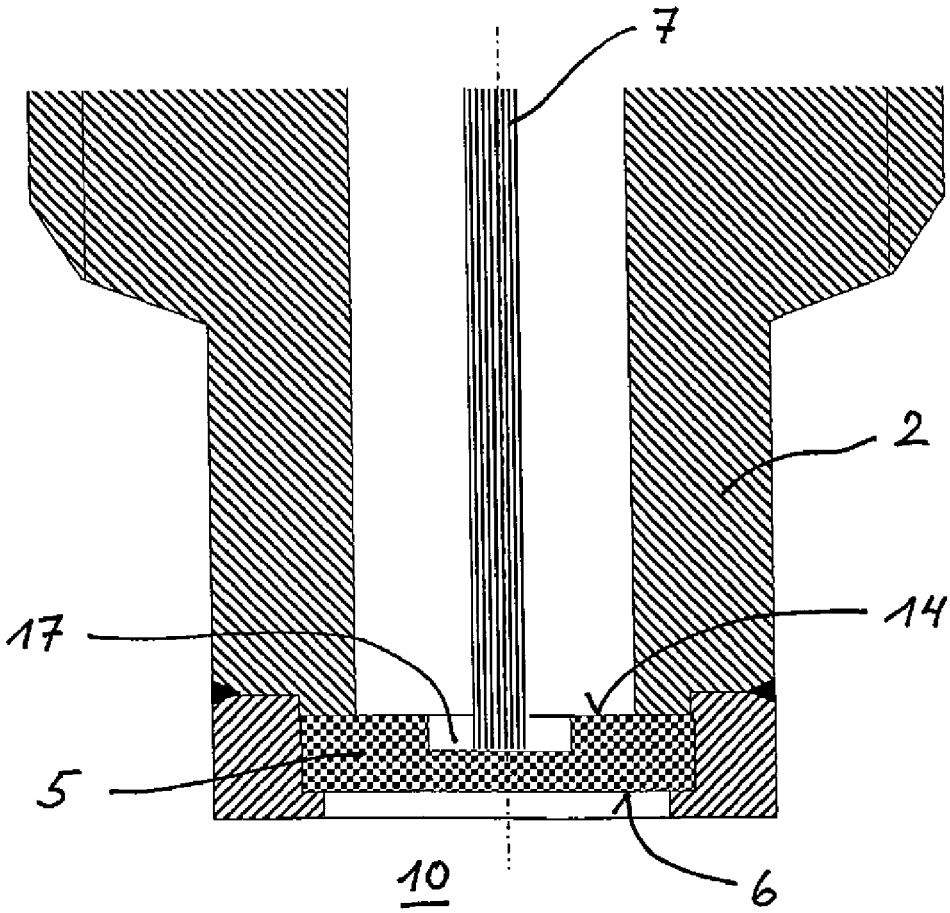
FIG. 4 shows a detail view in respect of FIG. 3.

FIG. 4 shows, in a detail representation, the lower end of the arrangement of FIG. 3, wherein it can clearly be seen that absorber body 5 is made from a material that absorbs the laser light, its combustion chamber outer side 14 facing away from prechamber 10 being sealed off with respect to the combustion chamber inner side 6. In this embodiment, absorber body 5 represents, as it were, a "black window", which is heated from its rear side by means of laser beam 7. Absorber body 5 is therefore a high temperature-resistant component, which is admitted or inserted in a sealed manner into the wall of prechamber 10. The material of absorber body 5 can therefore be selected independently of the material of the wall of prechamber 10 and can be adapted to the ignition conditions. The material of absorber body 5 is preferably different from the material of the wall of prechamber 10 that carries absorber body 5.

In contrast with known laser ignition systems, a feeding of laser beam 7 through an optical access into prechamber 10 is not required, as a result of which the process-related drawbacks of contamination/deposits are avoided. In addition, a smaller laser beam power is required. Absorber body 5 can be made from suitable materials, for example from a ceramic and/or from a tungsten carbide. Absorber body 5 is preferably designed disk-shaped. To advantage, absorber body 5 has a diameter of less than 10 mm, preferably less than 5 mm, particularly preferably less than 2 mm.

Furthermore, absorber body 5 advantageously comprises a recess 17 in which its thickness is reduced. Recess 17 can be formed on combustion chamber inner side 6 and/or combustion chamber outer side 14. Recess 17 advantageously has a diameter of less than 1 mm, preferably less than 0.5 mm, and the thickness of absorber body 5 in the region of recess 17 advantageously lies below 2 mm, preferably below 1 mm and particularly preferably below 0.5 mm. For strength reasons, a thick absorber body 5 is advantageous, in order to withstand the high cylinder pressures. For reasons of thermal conductivity and in order to achieve as rapid heating as possible with the smallest possible laser power, it is however desirable for absorber body 5 to be thin. These contradictory requirements can be met with a recess 17.

Figure 5:
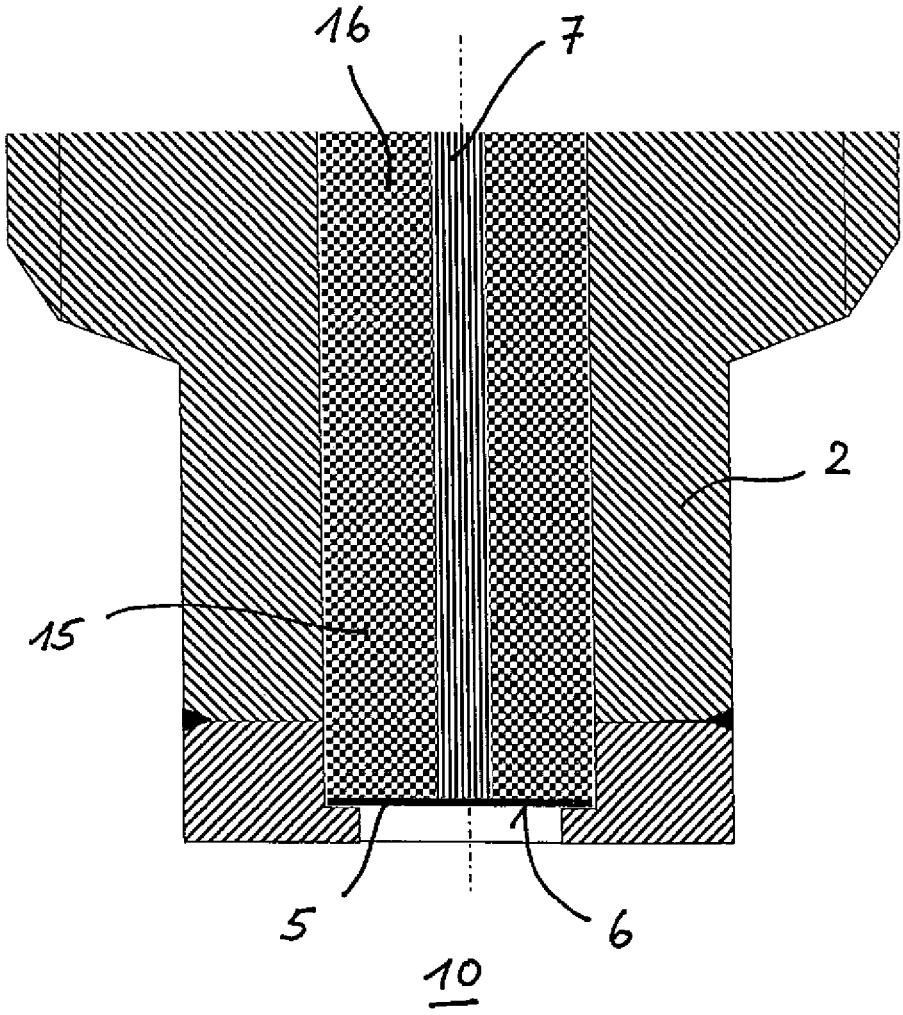
FIG. 5 shows a modification in respect of FIG. 4.

FIG. 5 shows a modified embodiment with respect to FIG. 4 in the case of a spark plug 2 with a beam guideway through a transparent material and an absorption of laser beam 7 in an absorbent coating applied on the transparent material, said coating forming absorber body 5. Absorber body 5 is thereby formed as a preferably deep-black material which absorbs the laser light, which is arranged on combustion chamber inner side 6 of a window material 15 facing prechamber 10. Absorber body 5 can be arranged on combustion chamber outer side 14 of window material 15 facing away from prechamber 10, or, as represented in FIG. 4, on the combustion chamber inner side 6 of window material 15 facing combustion chamber 10, window material 15 being transparent for laser light.

With these embodiments, absorber body 5 can for example be made from a ceramic, in particular a sintered ceramic, preferably of aluminum oxide or aluminum nitride, a metallic material, of carbide, boride, silicide or nitride. Window material 15 can be formed disk-shaped or as a light-conducting rod 16. It is made for example from a tungsten-silicate glass, a borosilicate glass or sapphire.

The light path positioned directly upstream of absorber body 5 or window material 15 can run through air, protective gas or a light conductor or light-conducting rod 16.

FIG. 6 shows the course of laser pulse power P as a function of time t. It can be seen that laser beam 7 is pulsed in working cycle T of the internal combustion engine. The pulse frequency of the laser pulses advantageously amounts to between 1 Hz and 2000 Hz, preferably between 1 Hz and 50 Hz. The pulse duration of the laser pulses advantageously lies between 0.1 μs and 1 min, preferably between 1 μs and 1 s, particularly preferably between 1 μs and 1 ms, wherein long pulse durations may be expedient especially for the temperature build-up with a cold start of the internal combustion engine. The rise time of the laser pulses advantageously amounts to between 1 ns and 1 ms, preferably between 100 ns and 10 μs, and the fall time of the laser pulses advantageously amounts to between 1 ns and 1 ms, preferably between 100 ns and 10 μs.

FIG. 7 represents the respective course of surface temperature TO of absorber body 5 on combustion chamber inner side 6 as a function of time. Ignition temperature TZ required for the mixture ignition is exceeded each time shortly after the triggering of a laser pulse. The required ignition temperature of the respective cycle may fluctuate on account of the influence of mixture composition, pressure, temperature and flow parameters at the ignition site. The required increase in surface temperature TO as a function of time results from is the requirement of the position of the ignition point of the mixture as a function of time. By preselecting the pulse duration and pulse rate, surface temperature TO for the mixture ignition can be adapted to different operational states of an engine (cold start, non-stationary operation, speed, load).

FIG. 8 shows, in a detail view in respect of FIG. 7, the course of surface temperature TO for an individual laser pulse as a function of time.

LIST OF REFERENCE NUMBERS

1 main combustion chamber
2 spark plug
3 external thread
4 gasket
5 absorber body
6 combustion chamber inner side
7 laser beam
8 laser
9 laser beam lens system
10 prechamber
11 overflow opening
12 front prechamber
13 rear prechamber
14 combustion chamber outer side
15 window material
16 light-conducting rod
17 recess
18 cylinder head
19 projection
P laser pulse power
T working cycle
TO surface temperature
TZ ignition temperature
t time

What is claimed is:

1. An ignition device for the ignition of a combustible or explosive gas mixture in a main combustion chamber (1), in particular for the ignition of a fuel-air mixture or a combustion gas-air mixture in an internal combustion engine, comprising a high temperature-resistant absorber body (5), which is arranged in contact with gas mixture coming from the main combustion chamber (1), with a combustion chamber inner side (6) facing the gas mixture, and a light guide path for guiding a laser beam (7) onto the absorber body (5) in order to heat the absorber body (5) with the laser beam (7) until an ignition temperature (TZ) required for the ignition of the gas mixture is reached on the combustion chamber inner side (6) of the absorber body (5), wherein the light guide path up to the absorber body (5) is configured in such a way that the laser beam (7) does not have direct contact with the gas mixture of the main combustion chamber (1), wherein a prechamber (10) with at least one overflow opening (11) connecting the prechamber (10) and the main combustion chamber (1) is located upstream of the absorber body (5) on the combustion chamber inner side (6), wherein the combustion chamber inner side (6) of the absorber body (5) is facing the gas mixture of the prechamber (10) and the light guide path up to the absorber body (5) is configured in such a way that the laser beam (7) does not have direct contact with the gas mixture of the prechamber (10).

2. The ignition device according to claim 1 wherein the absorber body (5) is designed disk-shaped.

3. The ignition device according to claim 1 wherein the absorber body (5) has a diameter of less than 10 mm, preferably less than 5 mm, particularly preferably less than 2 mm.

4. The ignition device according to claim 1 wherein the material of the absorber body (5) is different from the material of the wall of the prechamber (10) which carries the absorber body (5).

5. The ignition device according to claim 1 wherein the absorber body (5) is made from a material that absorbs the laser light, its combustion chamber outer side (14) facing away from prechamber (10) being sealed off with respect to the combustion chamber inner side (6).

6. The ignition device according to claim 1 wherein the absorber body (5) is made from a ceramic and/or from a tungsten carbide.

7. The ignition device according to claim 1 wherein the absorber body (5) is formed as a preferably deep-black material which absorbs the laser light, which is arranged on the combustion chamber inner side (6) of a window material (15) facing the prechamber (10) and the absorber body (5) is made from a ceramic, in particular a sintered ceramic, preferably of aluminum oxide or aluminum nitride, a metallic material, of carbide, boride, silicide or nitride.

8. The ignition device according to claim 1 wherein the absorber body (5) is formed as a preferably deep-black material which absorbs the laser light, which is arranged on the combustion chamber inner side (6) of a window material (15) facing the prechamber (10) and the window material (15) is formed as a light-conducting rod (16).

9. The ignition device according to claim 1 wherein the absorber body (5) is formed as a preferably deep-black material which absorbs the laser light, which is arranged on the combustion chamber inner side (6) of a window material (15) facing the prechamber (10) and the window material (15) is a tungsten-silicate glass, a borosilicate glass or sapphire.

10. The ignition device according to claim 1 wherein the laser beam (7) is pulsed.

11. The ignition device according to claim 1 wherein the laser (8) is integrated into the ignition device.

12. The ignition device according to claim 1 wherein the ignition device is designed in the form of a spark plug (2) which can be mounted in the wall of a cylinder head (18), said spark plug comprising the absorber body (5), a part of the light path and the prechamber (10).

13. The ignition device according to claim 1 wherein the laser (8) is integrated into the spark plug (2).

14. The ignition device according to claim 1 wherein the prechamber (10) is divided in the axial direction into a front prechamber (12) and a rear prechamber (13), wherein the rear prechamber (13) is positioned farther away from main combustion chamber (1) than the front prechamber (12) and wherein the diameter of the rear prechamber (13) is greater than the diameter of the front prechamber (12).

15. The ignition device according to claim 1 wherein the absorber body (5) is arranged on a projection (19), which projects with an immersion depth into the prechamber (10).

16. An internal combustion engine, in particular a petrol engine or gas engine, characterised in that it comprises an ignition device according to any one of the preceding claims.

17. A method for the ignition of a combustible or explosive gas mixture in a main combustion chamber (1), of a fuel-air mixture or a combustion gas-air mixture in an internal combustion engine, the method comprising contracting a high temperature-resistant absorber body (5) with a combustion chamber inner side (6) facing the gas mixture with gas mixture coming from the main combustion chamber (1), and guiding a light beam (7) along a light guide path onto the absorber body (5), wherein the absorber body (5) is heated with the laser beam (7) until an ignition temperature (TZ) required for the ignition of the gas mixture is reached on the combustion chamber inner side (6) of the absorber body (5), the light guide path up to the absorber body (5) being configured in that the laser beam (7) does not have direct contact with the gas mixture of the main combustion chamber (1), wherein a prechamber (10) with at least one overflow opening (11) connecting the prechamber (10) and the main combustion chamber (1) is located upstream of the absorber body (5) on the combustion chamber inner side (6), the combustion chamber inner side (6) of the absorber body (5) is arranged facing the gas mixture of the prechamber (10) and the light guide path up to the absorber body (5) is configured in order that the laser beam (7) does not have direct contact with the gas mixture of the prechamber (10).

* * * * *